US012698640B2

(12) United States Patent
Choi

(10) Patent No.: US 12,698,640 B2
(45) Date of Patent: Aug. 4, 2026

(54) TELESCOPIC POLES AND TENT FRAME HAVING SAME

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 278 days.

(21) Appl. No.: 18/659,513

(22) Filed: May 9, 2024

(65) Prior Publication Data

US 2025/0101767 A1 Mar. 27, 2025

(30) Foreign Application Priority Data

Sep. 26, 2023 (CN) ..... 202322609210.8

(51) Int. Cl.
*E04H 15/60* (2006.01)
*E04H 15/46* (2006.01)
*E04H 15/50* (2006.01)

(52) U.S. Cl.
CPC ..... *E04H 15/60* (2013.01); *E04H 15/46* (2013.01)

(58) Field of Classification Search
CPC ..... E04H 15/46; E04H 15/50; E04H 15/60
USPC ..... 135/75, 114, 139–142; 248/408
See application file for complete search history.

(56) References Cited

U.S. PATENT DOCUMENTS

| | | | | |
|---|---|---|---|---|
| 10,939,751 | B1 * | 3/2021 | Chen | A47C 19/024 |
| 11,330,900 | B2 | 5/2022 | Chen | |
| 2007/0012346 | A1 * | 1/2007 | Choi | F16B 7/105 135/120.3 |
| 2014/0130837 | A1 * | 5/2014 | Sy-Facunda | E04H 15/50 135/120.3 |
| 2019/0292808 | A1 * | 9/2019 | Dotterweich | E04H 15/02 |

* cited by examiner

*Primary Examiner* — Robert Canfield
(74) *Attorney, Agent, or Firm* — MORGAN, LEWIS & BOCKIUS LLP

(57) ABSTRACT

Disclosed are telescopic poles and tent frames having telescopic poles. A telescopic pole includes an inner tubular pole, an outer tubular pole, and a locking/unlocking mechanism to control relative movement of the inner and outer tubular poles. The locking/unlocking mechanism is operable between a locking state and an unlocking state. In the locking state, the locking/unlocking mechanism restricts the inner and outer tubular poles from moving toward each other but allows the inner and outer tubular poles to move away from each other. In the unlocking state, the locking/unlocking mechanism allows the inner and outer tubular poles to move toward as well as away from each other.

20 Claims, 7 Drawing Sheets

TELESCOPIC POLES AND TENT FRAME HAVING SAME

CROSS-REFERENCE TO RELATED APPLICATIONS

The present application claims priority to Chinese Utility Model Application no. 202322609210.8 filed Sep. 26, 2023. The disclosure of the application is incorporated herein for all purposes by reference in its entirety.

FIELD OF THE INVENTION

The present invention generally relates to telescopic poles and tent frames having such telescopic poles.

BACKGROUND

An existing pavilion type tent frame generally includes supporting poles and an upper frame supported by the supporting poles. However, supporting poles of many existing tent frames have fixed lengths or can only be adjusted to a few different lengths. As a result, the upper frames can only be supported at a fixed height or at a few different heights, and thus do not fully meet the needs or preferences of different people. In addition, many existing tent frames are cumbersome, and/or are difficult to fold and unfold, making them inconvenient to use.

Given the current state of the art, there remains a need for telescopic poles and tent frames that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides telescopic poles that can be quickly adjusted to multiple different lengths and tent frames that can be safely and conveniently adjusted to various different heights.

In various exemplary embodiments, the present disclosure provides a telescopic pole including an outer tubular pole, an inner tubular pole, and a locking/unlocking mechanism. The outer tubular pole includes a first restriction slot formed on a first wall of the outer tubular pole. The inner tubular pole includes a proximal end disposed inside the outer tubular pole and a distal end disposed outside the outer tubular pole. The inner tubular pole also includes a plurality of restriction structures formed at the inner tubular pole between the proximal end and distal end of the inner tubular pole and spaced apart along a length direction of the inner tubular pole. Each of the plurality of restriction structures includes a second restriction slot formed on a first wall of the inner tubular pole that faces the first wall of the outer tubular pole. The locking/unlocking mechanism is configured to control movement of the inner tubular pole with respect to the outer tubular pole. The locking/unlocking mechanism includes a base, a casing, a lever and a locking member. The base is fixedly coupled with the outer tubular pole, and the casing is integrally formed or coupled with the base. The lever is lever pivotally connected to the casing, and the locking member is pivotally connected to the lever. The locking member includes a first edge sloped along the length direction of the inner tubular pole. The base or the casing includes a third restriction slot corresponding to the first restriction slot of the outer tubular pole and configured to guide the locking member to move along a width direction of the inner tubular pole between a first position and a second position when the lever pivots relative to the casing. At the first position, the locking member is inserted into the first restriction slot of the outer tubular pole and the second restriction slot of any one respective restriction structure in the plurality of restriction structures of the inner tubular pole, with a proximal end of the first edge disposed inside of the inner tubular pole and a distal end of the first edge disposed outside the inner tubular pole, thereby restricting the inner tubular pole from moving toward the outer tubular pole along the length direction of the inner tubular pole but allowing the inner tubular pole to move away from the outer tubular pole along the length direction of the inner tubular pole. At the second position, the locking member is removed from the second restriction slot of any one respective restriction structure in the plurality of restriction structures of the inner tubular pole, thereby allowing the inner tubular pole to move away from the outer tubular pole and to move toward the outer tubular pole.

In an exemplary embodiment, the inner tubular pole or the outer tubular pole has a cross section in a substantially rectangular or square shape.

In some exemplary embodiments, each of the plurality of restriction structures of the inner tubular pole include a restriction tongue at a proximal edge of the second restriction slot to prevent insertion of the locking member into the second restriction slot beyond the first position, and/or to aid the inner tubular pole to move away from the outer tubular pole along the length direction of the inner tubular pole when the locking member is at the first position.

In some exemplary embodiments, the restriction tongue is shaped in accordance with the first edge of the locking member.

In an exemplary embodiment, the restriction tongue abuts the first edge of the locking member to guide movement of the locking member when the locking member is in the first position and the inner tubular pole moves away from the outer tubular pole.

In an exemplary embodiment, the lever includes a first limiting member and a second limiting member spaced apart from each other in a depth direction of the inner tubular pole to accommodate the locking member.

In some exemplary embodiments, the first edge of the locking member is substantially straight.

In an exemplary embodiment, the first edge of the locking member is slanted relative to the length direction of the inner tubular pole at an angle within a range of from about 15° to about 45°.

In some exemplary embodiments, the locking member includes a proximal edge and a distal edge that are substantially straight and substantially perpendicular to the length direction of the inner tubular pole.

In an exemplary embodiment, the locking member has a first dimension within a range of from about 15 mm to about 30 mm, and a second dimension within a range of from about 1 mm to about 3 mm.

In some exemplary embodiments, the base includes the third restriction slot and a support formed at a first side wall of the base. The casing is integrally formed or coupled with the first side wall of the base and surrounds the third restriction slot and the support. The lever includes a first portion aligned with the third restriction slot, a second portion aligned with the support, and a third portion between the first and second portions and pivotally connected to the casing.

In some exemplary embodiments, the locking/unlocking mechanism further includes an elastic member engaged with the support. The elastic member has a first end abutting the base and a second end abutting the second portion of the lever. As such, when the second restriction slot of a restriction structure in the plurality of restriction structures of the inner tubular pole aligns with the first restriction slot of the outer tubular pole, the elastic member pushes the locking member into the second restriction slot of the restriction structure of the inner tubular pole.

In some exemplary embodiments, the plurality of restriction structures includes at least 10 restriction structures.

In some exemplary embodiments, the plurality of restriction structures is distributed over at least half of the inner tubular pole along the length direction of the inner tubular pole.

In some exemplary embodiments, adjacent restriction structures in the plurality of restriction structures are spaced apart along the length direction of the inner tubular pole at a distance within a range of from about 3 cm to about 5 cm, from about 4 cm to about 6 cm, or from about 5 cm to about 7 cm.

In an exemplary embodiment, the inner tubular pole further includes a plurality of indicators adjacent to the plurality of restriction structures to indicate positions of the plurality of restriction structures and/or relative positions of the inner tubular pole with respect to the outer tubular pole.

In various exemplary embodiments, the present disclosure provides a telescopic pole including an outer tubular pole, an inner tubular pole and a locking/unlocking mechanism. The outer tubular pole includes a first restriction slot formed on a first wall of the outer tubular pole. The inner tubular pole includes a proximal end disposed inside the outer tubular pole and a distal end disposed outside the outer tubular pole. The inner tubular pole also includes a plurality of restriction structures disposed between the proximal end and distal end of the inner tubular pole and spaced apart along a length direction of the inner tubular pole. The plurality of restriction structures includes at least 10 restriction structures and distributed over at least half of the inner tubular pole along the length direction of the inner tubular pole. Each of the plurality of restriction structures includes a second restriction slot. The locking/unlocking mechanism is configured to control movement of the inner tubular pole with respect to the outer tubular pole, and operable between a first state and a second state. At the first state, the locking/unlocking mechanism allows the inner tubular pole to move away from the outer tubular pole along the length direction of the inner tubular pole but restricts the inner tubular pole from moving toward the outer tubular pole along the length direction of the inner tubular pole. At the second state, the locking/unlocking mechanism allows the inner tubular pole to move away from the outer tubular pole and to move toward the outer tubular pole.

In some exemplary embodiments, adjacent restrictions in the plurality of restriction structures are spaced apart along the length direction of the inner tubular pole at a distance within a range of from about 3 cm to about 5 cm, from about 4 cm to about 6 cm, or from about 5 cm to about 7 cm.

In various exemplary embodiments, the present disclosure provides a tent frame including an upper frame and a plurality of telescopic poles of the present disclosure. Each telescopic pole in the plurality of telescopic poles has a first end connected to the upper frame and a second end abutting a surface when the tent frame is in use.

In some exemplary embodiments, the plurality of telescopic poles includes at least 3, at least 4, at least 5, at least 6, at least 7, or at least 8 telescopic poles.

The telescopic poles and tent frames of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

DETAILED DESCRIPTION

Figure 1:
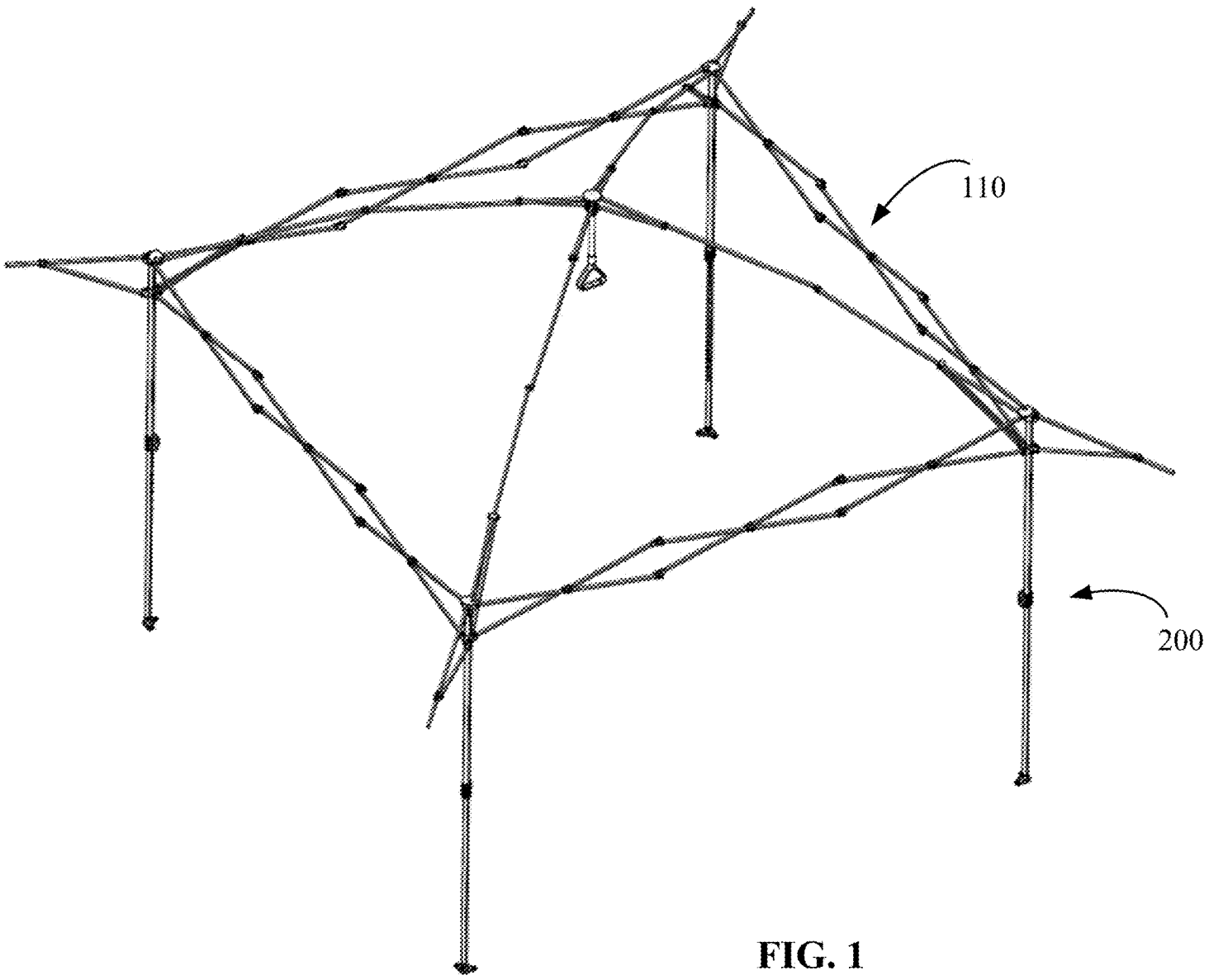
FIG. 1 is a perspective view illustrating an exemplary tent frame in accordance with some exemplary embodiments of the present disclosure.

The present disclosure provides telescopic poles and tent frames having such telescopic poles. A telescopic pole of the present disclosure generally includes an inner tubular pole, an outer tubular pole and a locking/unlocking mechanism configured to control the movement of the inner and outer tubular poles relative to each other. The locking/unlocking mechanism is operable between a locking state and an unlocking state. In the locking state, the locking/unlocking mechanism restricts the inner and outer tubular poles from moving toward each other but allows the inner and outer tubular poles to move away from each other. In other words, the locking/unlocking mechanism allows the telescopic pole to expand (e.g., increase its length) even when it is in the locking state. As such, there is no need to unlock the locking/unlocking mechanism when setting up the tent frame and when it is desired to increase the height of the tent frame. Accordingly, the tent frame of the present disclosure is very simple and easy to use. In addition, a telescopic pole of the present disclosure can be adjusted to ten or more different lengths. This allows the tent frame of the present disclosure to be adjusted to ten or more different heights to meet needs or preferences of various users.

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

As used herein, the term "about" or "approximately" can mean within an acceptable error range for the particular value as determined by one of ordinary skill in the art, which can depend in part on how the value is measured or determined, e.g., the limitations of the measurement system. For example, "about" can mean within 1 or more than 1 standard deviation, per the practice in the art. "About" can mean a range of ±20%, ±10%, ±5%, or ±1% of a given value. Where particular values are described in the application and claims, unless otherwise stated, the term "about" means within an acceptable error range for the particular value. The term "about" can have the meaning as commonly understood by one of ordinary skill in the art. The term "about" can refer to ±10%. The term "about" can refer to ±5%.

In addition, when a reference number is given an "$i^{th}$" denotation, the reference number refers to a generic component, set, or embodiment. For instance, a restriction structure "restriction structure i" refers to the $i^{th}$ restriction structure in a plurality of restriction structures (e.g., a restriction structure 230-*i* in a plurality of restriction structures 230).

Referring now to FIG. 1, there is depicted an exemplary tent frame, generally designated 100, in accordance with some exemplary embodiments of the present disclosure. Tent frame 100 includes an upper frame, such as upper frame 110, and a plurality of telescopic poles, such as telescopic pole 200. The plurality of telescopic poles is coupled with the upper frame and supports the upper frame when the tent frame is in use. While FIG. 1 illustrates that the upper frame has a substantially square shape and is supported by four telescopic poles, it should be noted that the present disclosure is not limited thereto. The upper frame can be of any other shapes including but not limited to triangular, rectangular, and circular, and can be supported by any suitable number of telescopic poles including but not limited to three, four, five, six, seven, eight or more than eight telescopic poles.

In some exemplary embodiments, each telescopic pole 200 has a first end (e.g., the upper end in the figure) and a second end (e.g., the lower end in the figure). When the tent frame is in use, the first end of the telescopic pole is connected to the upper frame, for instance, by a connector disposed at the first end of the telescopic pole. The second end of the telescopic pole abuts a surface (e.g., a ground surface), for instance, through a base disposed at the second end of the telescopic pole. In some exemplary embodiments, each telescopic pole 200 is disposed substantially perpendicular to the ground surface (e.g., vertically in the figure) when the tent frame is in use.

Referring to FIGS. 2-8, there is depicted an exemplary telescopic pole, generally designated 200, in accordance with some exemplary embodiments of the present disclosure. In various exemplary embodiments, telescopic pole 200 includes an outer tubular pole, such as outer tubular pole 210, an inner tubular pole, such as inner tubular pole 220, and a locking/unlocking mechanism, such as locking/unlocking mechanism 300. As used herein, the term "tubular pole" refers to an elongated pole that is hollow along a portion or an entire length of the pole. The cross section of a tubular pole can be of any suitable shape, e.g., regular or irregular, including but not limited to circular, polygonal and oval and oblong. In an exemplary embodiment, the cross section of the inner or outer tubular pole is substantially square or rectangular.

Figure 2:
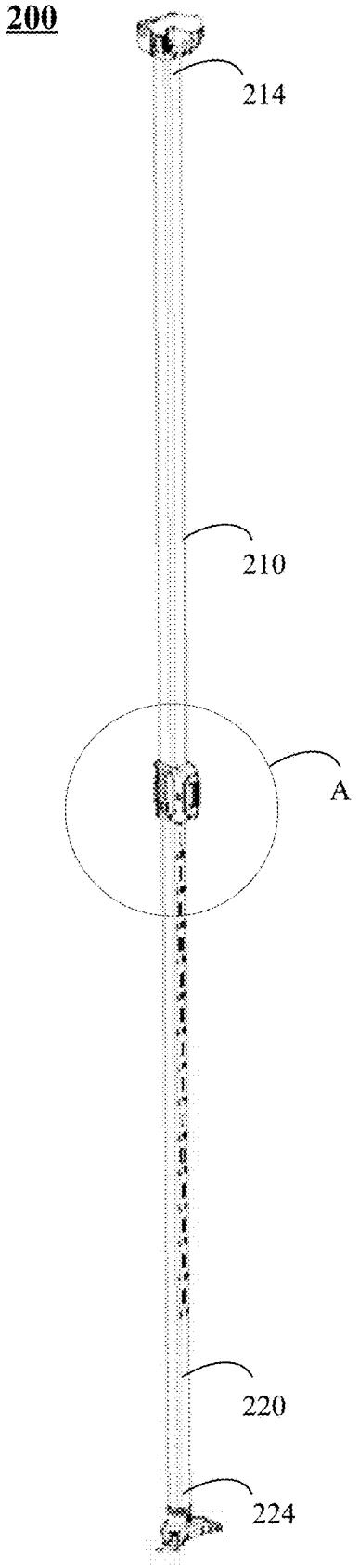
FIG. 2 is a perspective view illustrating an exemplary telescopic pole in accordance with some exemplary embodiments of the present disclosure.
Figure 3:
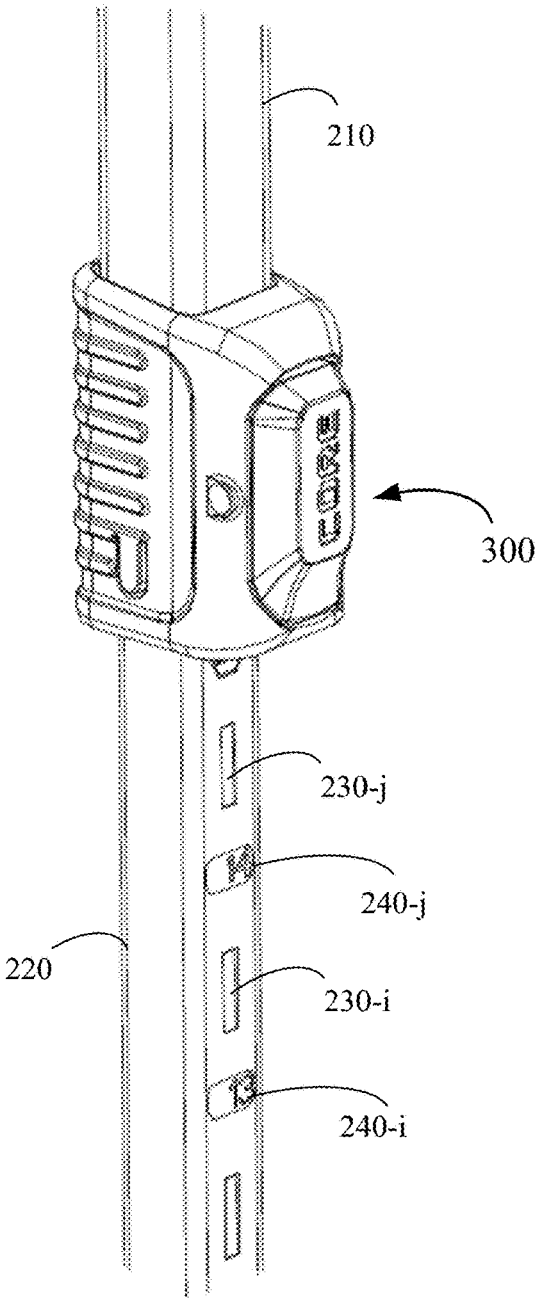
FIG. 3 is an enlarged view taken along circle A of FIG. 2.
Figure 5:
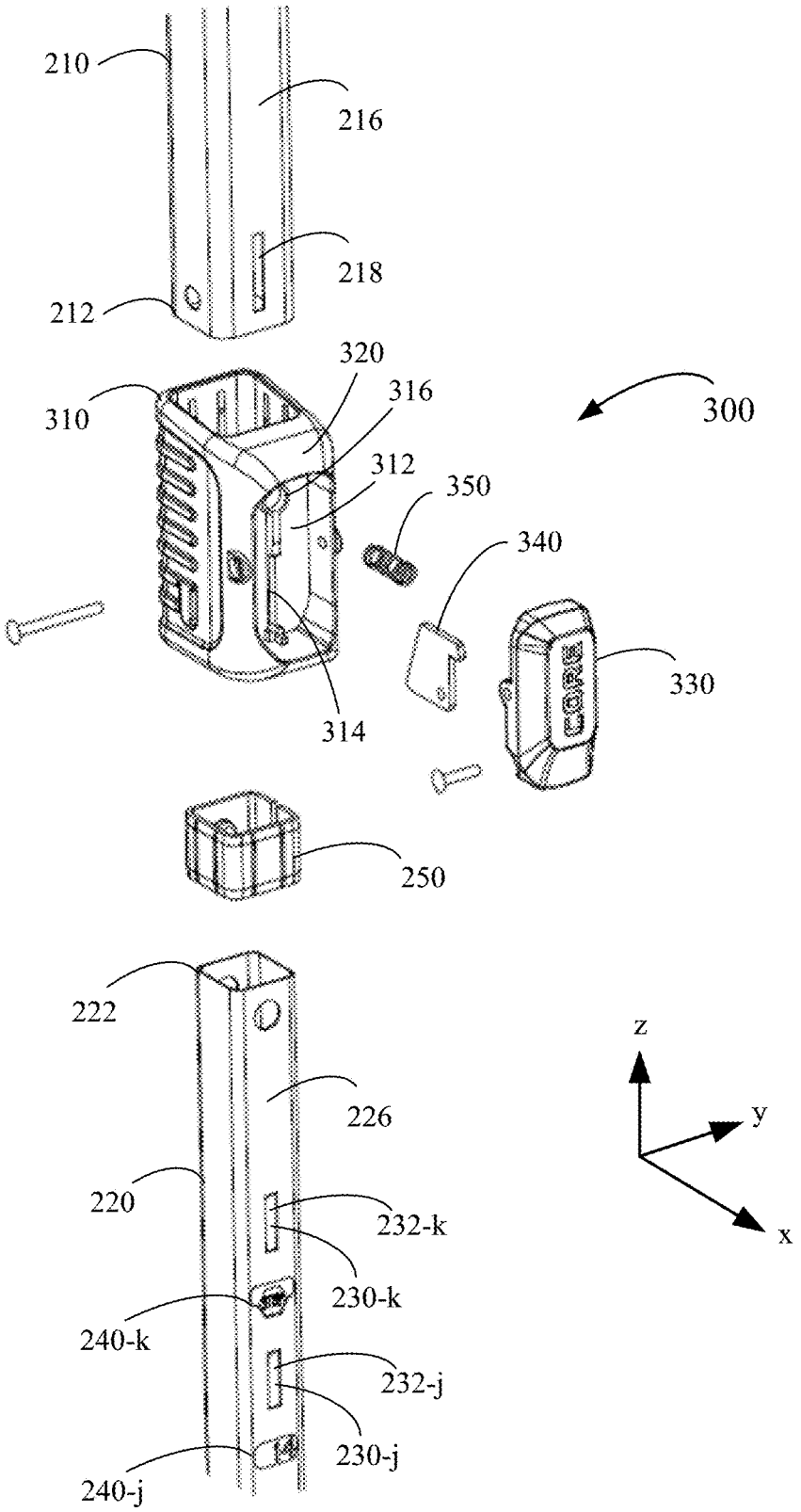
FIG. 5 is a perspective view illustrating some components (disassembled) of the exemplary telescopic pole of FIG. 2 in accordance with some exemplary embodiments of the present disclosure.

Referring in particular to FIGS. 2, 3, and 5, the outer tubular pole and the inner tubular pole are movably coupled to each other, with at least a portion of the inner tubular pole being inserted in the outer tubular pole. For instance, in some exemplary embodiments, the outer tubular pole includes a proximal end 212 and a distal end 214, and the inner tubular pole includes a proximal end 222 and a distal end 224. As used herein, proximal end 212 of the outer tubular pole refers to its end portion located closer to the inner tubular pole and distal end 214 refers to its end portion located away from the inner tubular pole. Similarly, proximal end 222 of the inner tubular pole refers to its end portion located closer to the outer tubular pole and distal end 224 of the inner tubular pole refers to its end portion located away from the outer tubular pole. In the illustrated embodiment, proximal end 222 of the inner tubular pole is disposed inside the outer tubular pole, and distal end 224 of the inner tubular pole is disposed outside the outer tubular pole.

In some exemplary embodiments, the outer tubular pole includes a first restriction slot, such as first restriction slot 218. The first restriction slot is formed on a first wall, such as first wall 216, of the outer tubular pole. In an exemplary embodiment, the first restriction slot of the outer tubular pole is formed at a position adjacent to proximal end 212 of the outer tubular pole. In some exemplary embodiments, the first restriction slot is elongated in a length direction of the outer tubular pole (e.g., the z-direction of FIG. 5). In an exemplary embodiment, the first restriction slot has a first dimension (e.g., in the y-direction of FIG. 5) within a range of about 2 millimeter (mm) to 4 mm and a second dimension (e.g., the z-direction of FIG. 5) within a range of about 18 mm to 26 mm.

In some exemplary embodiments, the inner tubular pole includes a first wall, such as first wall 226 and a plurality of restriction structures, such as restriction structures 230-*i*, 230-*j*, 230-*k*. The plurality of restriction structures is formed at the first wall of the inner tubular pole between the proximal end and distal end of the inner tubular pole and spaced apart along the length direction of the inner tubular pole. First wall 226 of the inner tubular pole corresponds to first wall 216 of the outer tubular pole (e.g., the first wall of the inner tubular pole and the first wall of the outer tubular pole are disposed side by side to each other). The plurality of restriction structures of the inner tubular pole corresponds to the first restriction slot of the outer tubular pole. The inner tubular pole can include any suitable number of restriction structures. In some exemplary embodiments, the plurality of restriction structures includes at least 10 restriction structures, at least 12 restriction structures, or at least 14 restriction structures.

In some exemplary embodiments, the plurality of restriction structures is distributed over at least half of the inner tubular pole along the length direction of the inner tubular pole without compromising the strength and/or other integrity of the inner tubular pole. In an exemplary embodiment, the plurality of restriction structures is distributed over at least 60%, at least 65%, at least 70% or at least 75% of the inner tubular pole along the length direction of the inner tubular pole without compromising the strength and/or other integrity of the inner tubular pole. In some exemplary embodiments, adjacent restriction structures in the plurality of restriction structures are spaced apart along the length direction of the inner tubular pole at a distance within a range of from about 3 centimeter (cm) to about 5 cm, from about 4 cm to about 6 cm, or from about 5 cm to about 7 cm. In an exemplary embodiment, the portion of the inner tubular pole having the plurality of restriction structures has a length of at least 0.8 meter (m), at least 0.9 m, at least 1 m, at least 1.1 m, or at least 1.2 m.

While it is illustrated that restriction structures in the plurality of restriction structures are almost identical and distributed uniformly over the portion of the inner tubular pole, it should be noted that the present disclosure is not limited thereto. Different restriction structures in the plurality of restriction structures can have different configurations in terms of their sizes, shapes, and/or other parameters. Also, restriction structures in the plurality of restriction structures can be distributed non-uniformly over the portion of the inner tubular pole, for instance, with varied spacings.

In some exemplary embodiments, the inner tubular pole includes a plurality of indicators, such as indicators 240-*i*, 240-*j* and 240-*k*, to indicate positions of the plurality of restriction structures, relative positions of the inner tubular pole with respect to the outer tubular pole, and/or other characteristics of the telescopic pole. An indicator can be a number (e.g., "13", "14"), a text (e.g., "stop"), an image, or the like. With the plurality of indicators, it is easy to visually observe the length of the telescopic pole and thus the height of the tent frame, thereby making the adjustment quick, simple and safe.

The inner tubular pole can have the same number of the indicators as the restriction structures, or different numbers of the indicators than the restriction structures. The plurality of indicators can be distributed along a portion of the length of the inner tubular pole the same as or different than the plurality of restriction structures. As a non-limiting example, it is illustrated that the plurality of indicators is disposed adjacent to the plurality of restriction structures, e.g., indicator 240-*j* disposed adjacent to restriction structure 230-*j* and indicator 240-*k* disposed adjacent to restriction structure 230-*k*.

In some exemplary embodiments, a stopper, such as stopper 250, is fixedly coupled with (e.g., snap-fitted, fastened, glued) the inner tubular pole, for instance, at or adjacent the proximal end of the inner tubular pole. The stopper is configured to help smooth the movement of the inner tubular pole relative to the outer tubular pole and/or to prevent the inner tubular pole from being completely pulled out from the outer tubular pole.

Figure 7:
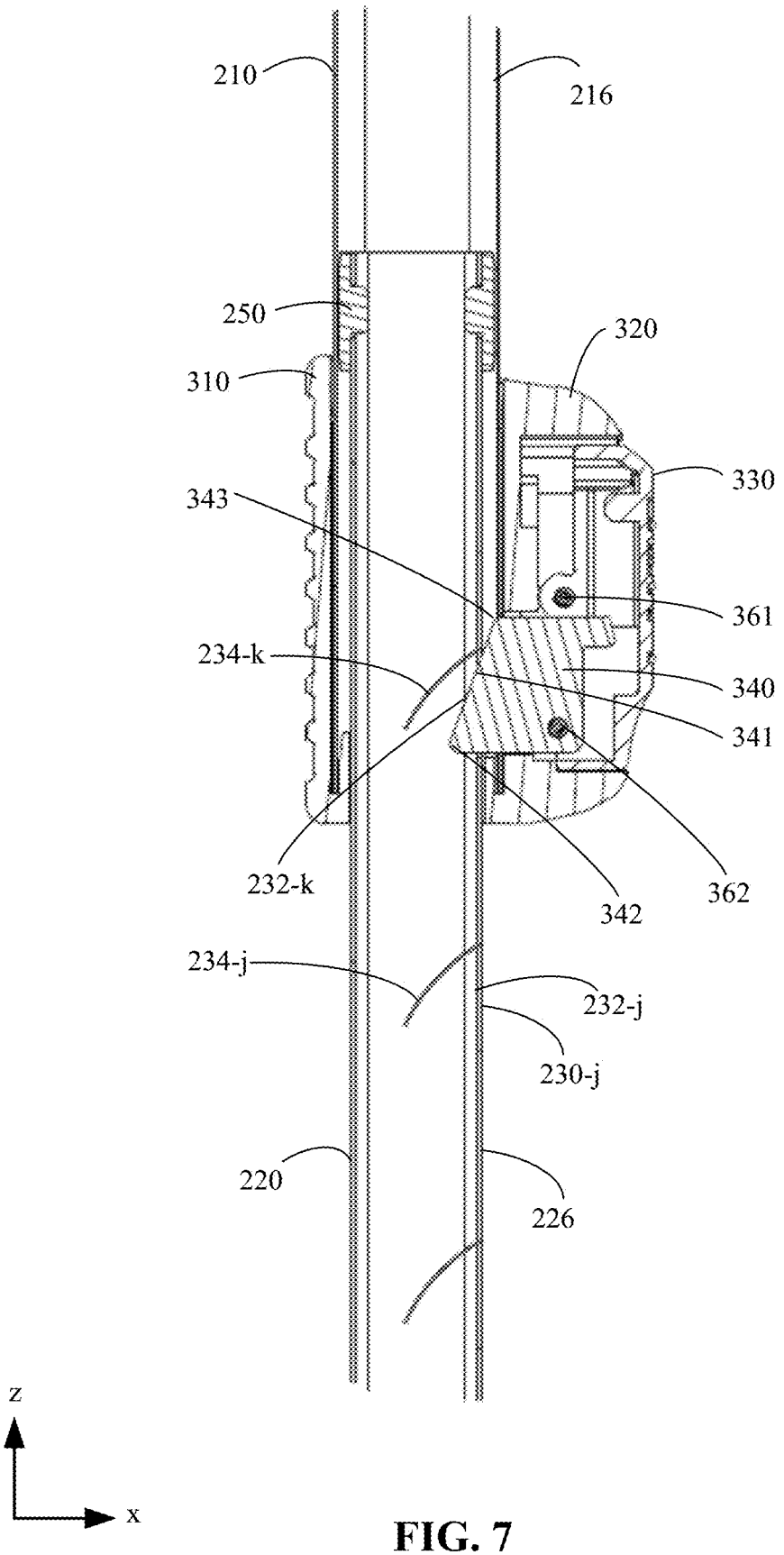
FIG. 7 is a cross-sectional view illustrating some components of the exemplary telescopic pole of FIG. 2 in a first state in accordance with some exemplary embodiments of the present disclosure.
Figure 8:
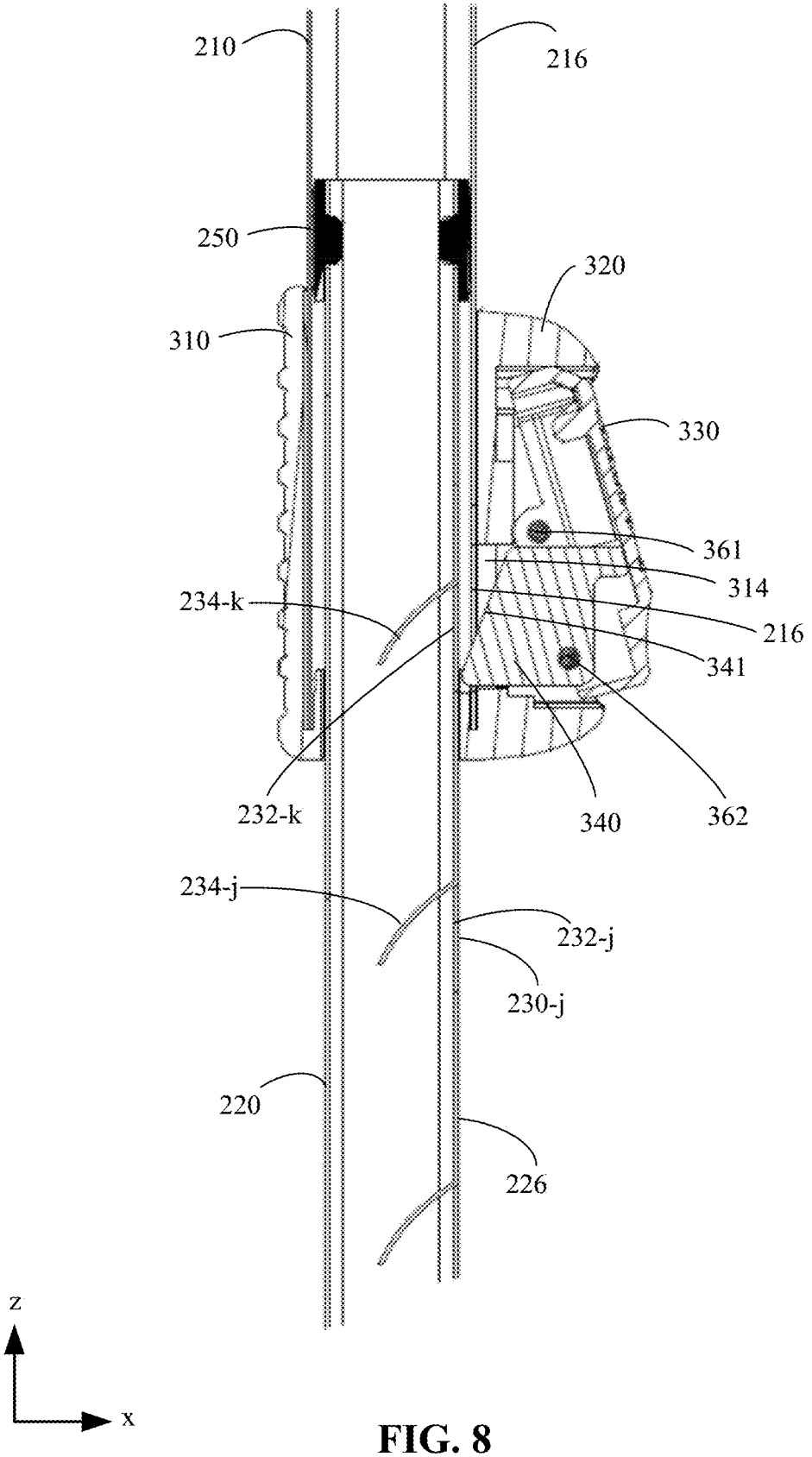
FIG. 8 is a cross-sectional view illustrating some components of the exemplary telescopic pole of FIG. 2 in a second state in accordance with some exemplary embodiments of the present disclosure.

Referring in particular to FIGS. 5, 7 and 8, in some exemplary embodiments, each restriction structure includes a second restriction slot, e.g., restriction structure 230-*j* including second restriction slot 232-*j* and restriction structure 230-*k* including second restriction slot 232-*k*. In an exemplary embodiment, second restriction slot 232 has similar shape and/or size as first restriction slot 218 of the outer tubular pole.

In some exemplary embodiments, each restriction structure includes a restriction tongue, e.g., restriction structure 230-*j* including restriction tongue 234-*j* and restriction structure 230-*k* including restriction tongue 234-*k*. In some exemplary embodiments, a respective second restriction slot (e.g., restriction structure 230-*k*) includes a proximal edge (e.g., the upper edge in FIG. 5) and a distal edge (e.g., the lower edge in FIG. 5). The corresponding restriction tongue (e.g., restriction tongue 234-*k*) is integrally formed or connected to the proximal edge of the respective second restriction slot and curved or sloped inwardly with respect to the first wall of the inner tubular pole along the length direction of the inner tubular pole toward the distal edge of the respective second restriction slot. The corresponding restriction tongue can be curved or straight. In some exemplary embodiments, the respective second restriction slot and the corresponding restriction tongue are formed by punching or stamping the first wall of the inner tubular pole.

Figure 4:
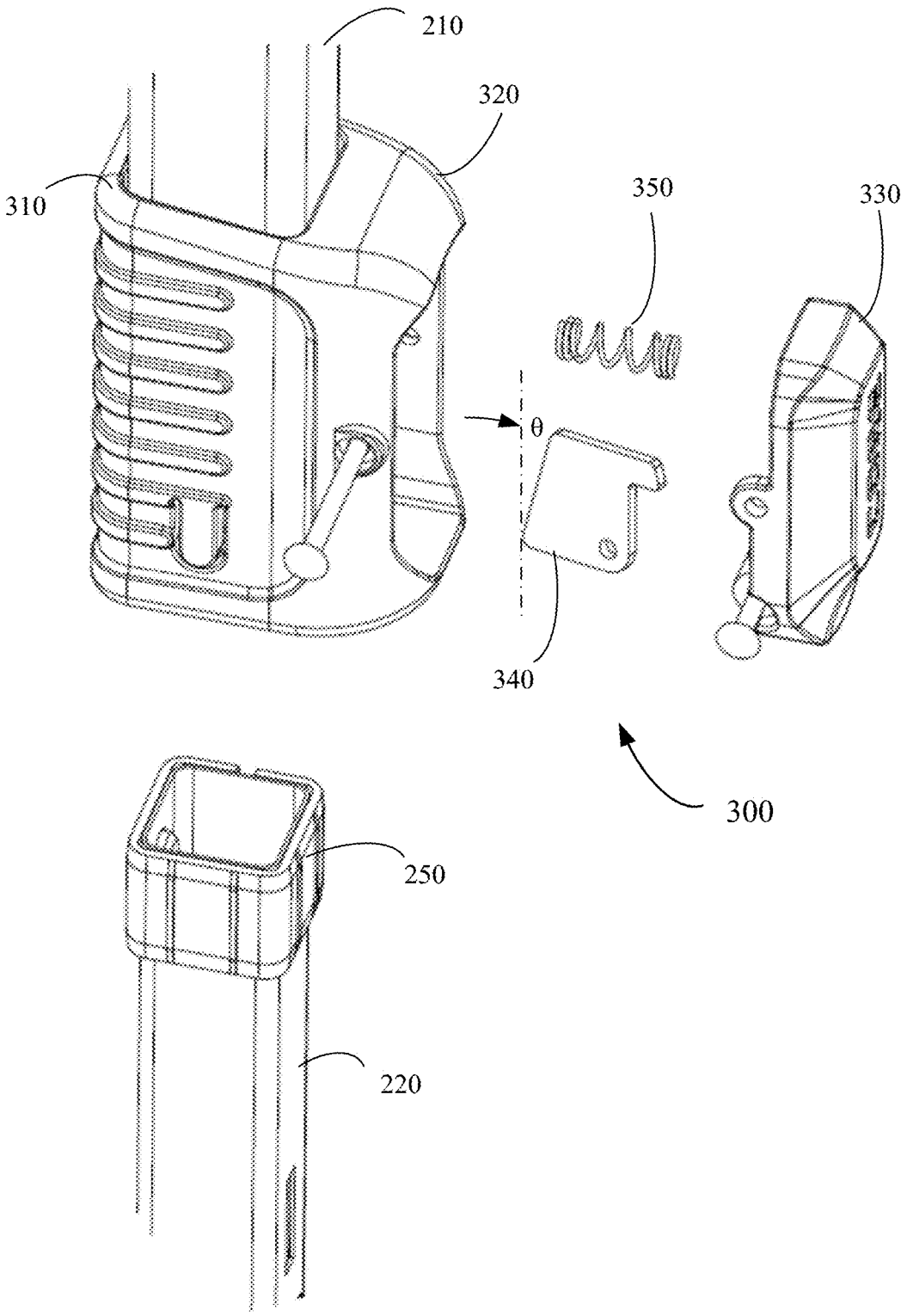
FIG. 4 is a perspective view illustrating some components (partially disassembled) of the exemplary telescopic pole of FIG. 2 in accordance with some exemplary embodiments of the present disclosure.
Figure 6:
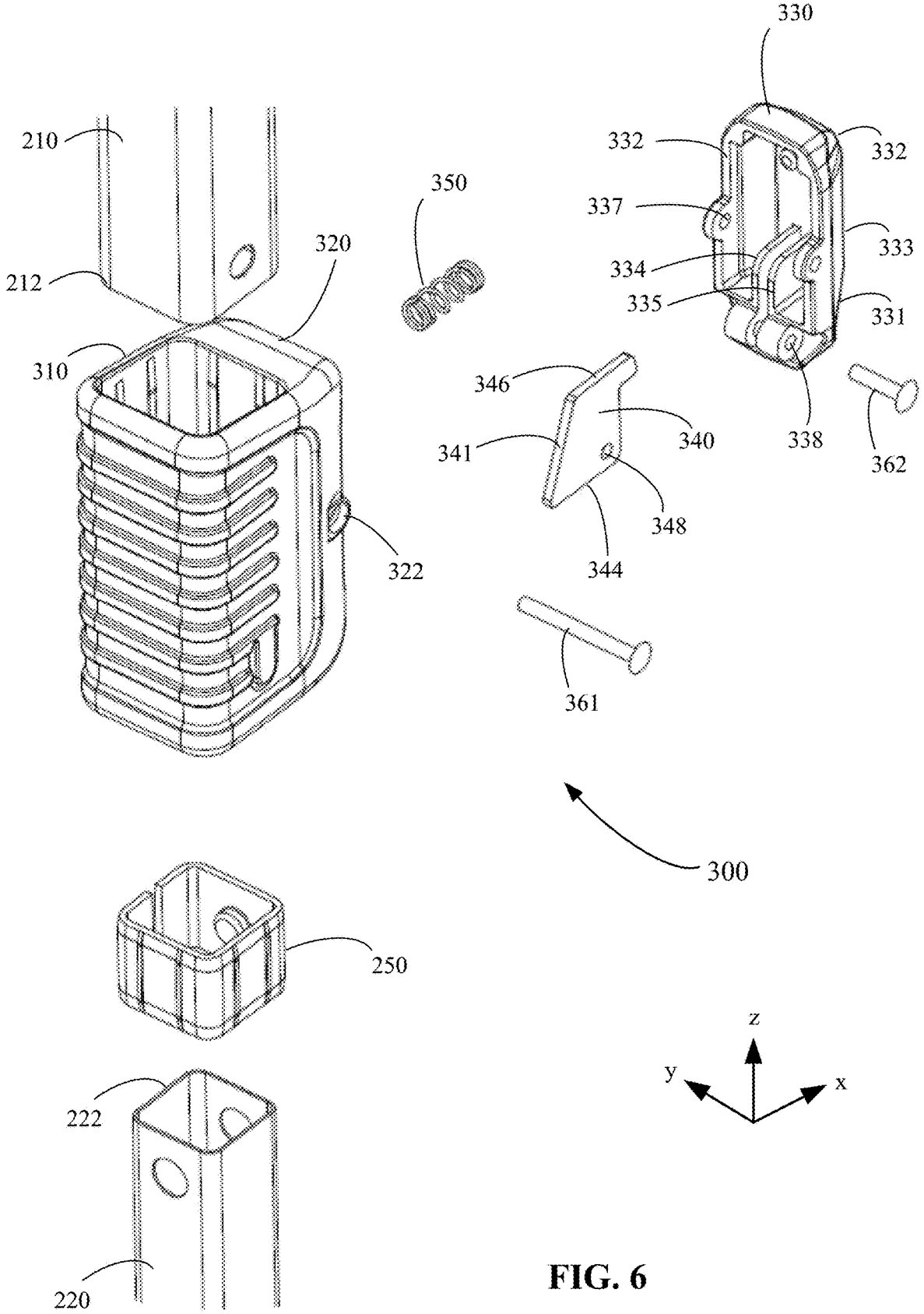
FIG. 6 is another perspective view illustrating some components (disassembled) of the exemplary telescopic pole of FIG. 2 in accordance with some exemplary embodiments of the present disclosure.

Referring in particular to FIGS. 4-6, locking/unlocking mechanism 300 is configured to control movement of the inner tubular pole with respect to the outer tubular pole. In some exemplary embodiments, locking/unlocking mechanism 300 includes a base, such as base 310, a casing, such as casing 320, a lever, such as lever 330, and a locking member, such as locking member 340. Additionally, or optionally, in some exemplary embodiments, the locking/unlocking mechanism includes an elastic member, such as elastic member 350.

Base 310 is fixedly coupled with (e.g., snap-fitted, fastened, glued) the outer tubular pole, for instance, at or adjacent to the proximal end of the outer tubular pole. In some exemplary embodiments, the base includes a first side wall, at which a third restriction slot, a support and/or other features are formed. For instance, as a non-limiting example, it is illustrated that the base includes first side wall 312, at which third restriction slot 314 and support 316 are formed. The third restriction slot is positioned in accordance with the first restriction slot of the outer tubular pole, for instance, aligned with the first restriction slot of the outer tubular pole, such that the first restriction slot of the outer tubular pole is accessible through the third restriction slot. In some exemplary embodiments, the third restriction slot and the support are formed at the first side wall of the base with one above another along the length direction of the outer tubular pole.

Casing 320 is integrally formed (e.g., by molding) or coupled (e.g., glued or fastened) with base 310 (e.g., the first side wall of the base). For instance, in an exemplary embodiment, the base and casing are formed by molding as a unitary piece. The casing can have any suitable shapes. In some embodiments, the casing encloses or surrounds the third restriction slot and base support formed at the first side wall of the base. In an exemplary embodiment, the casing includes a circumferential wall extended from the base such that the first side wall of the base or a portion of it serves as the bottom of the casing.

Lever 330 is pivotally connected to casing 320. For instance, in some exemplary embodiments, the lever includes a first portion 331 aligned with the third restriction slot of the base/casing, a second portion 332 aligned with the support of the base/casing, and a third portion 333 between the first and second portions. In an exemplary embodiment, the third portion of the lever is pivotally connected to the casing by a rod passing through holes formed at the casing and the third portion of the lever. For instance, in the illustrated embodiment, the third portion of the lever is pivotally connected to the casing by rod 361 passing through hole 322 formed at the casing and hole 337 formed at the third portion of the lever.

Locking member 340 includes a first edge, such as first edge 341, generally sloped along the length direction of the inner tubular pole. Preferably, the first edge of the locking member is substantially straight. However, the present disclosure is not limited thereto. The first edge of the locking member can be curved. In some exemplary embodiments, the first edge of the locking member is oblique relative to the length direction of the inner tubular pole at an angle "θ" within a range of from about 15° to about 45°.

In some exemplary embodiments, locking member 340 includes a proximal edge, such as proximal edge 344, and a distal edge, such as distal edge 346. In the fully assembled telescopic pole, the proximal edge of the locking member is located relatively closer to proximal edge 212 of the outer tubular pole and the distal edge of the locking member is located relatively away from proximal edge 212 of the outer tubular pole. In some exemplary embodiments, the proximal and distal edges of the locking member are substantially straight and/or substantially perpendicular to the length direction of the inner tubular pole. In some embodiments, the distance between the proximal and distal edges (e.g., a dimension in the z-direction of FIG. 6) defines a height of the locking member. In an exemplary embodiment, the height of the locking member has a value within a range of from about 15 mm to about 30 mm. In some embodiments, the locking member is a substantially flat piece having a thickness (e.g., a dimension in the y-direction of FIG. 6) within a range of from about 1 mm to about 3 mm.

Locking member 340 is pivotally connected to lever 330, for instance, by a rod passing through holes formed at the locking member and the first portion of the lever. As a non-limiting example, it is illustrated that the locking member is pivotally connected to the lever by rod 362 passing through hole 348 formed at the locking member and hole 338 formed at the first portion of the lever. In some exemplary embodiments, the lever includes a first limiting member, such as first limiting member 334, and a second limiting member, such as second limiting member 335. The first and second limiting members are spaced apart from each other in a depth direction of the inner tubular pole (e.g., the y-direction in FIG. 6) to accommodate the locking member. In some exemplary embodiments, the locking member is placed in between the first and second limiting members. The first and second limiting members restricts the movement of the locking member in the depth direction of the inner tubular pole, thereby help to stabilize the operation of the locking/unlocking mechanism.

Elastic member 350 is engaged with the support formed at the first side wall of the base. In some exemplary embodiments, the elastic member has a first end abutting the bottom of the casing (e.g., the first side wall of the base) and a second end abutting the second portion of the lever. As such, the elastic member exerts an elastic force to the second portion of the lever, thereby pushing the first portion of the lever toward the third restriction slot of the base/casing. In an exemplary embodiment, the elastic member is a spring.

Referring in particular to FIGS. 5, 7 and 8, locking member 340 is movable between a first position as illustrated in FIG. 7 and a second position as illustrated in FIG. 8. In some embodiments, the locking member is movably coupled to third restriction slot 314, which is configured to help guide the movement of the locking member along a width direction of the inner tubular pole (e.g., the x-direction of FIG. 7). For instance, in an exemplary embodiment, the locking member is inserted at least partially into the third restriction slot and is slidable relative to the third restriction slot. When any one of the plurality of restriction structures of the inner tubular pole is aligned with the first restriction slot of the outer tubular pole and the third restriction slot of the base/casing, the locking member is inserted (e.g., pushed by the elastic member through the lever) into the first restriction slot of the outer tubular pole and the second restriction slot of the respective restriction structure. For instance, as a non-limiting example, FIG. 7 illustrates that restriction structure 230-*k* is aligned with the first restriction slot of the outer tubular pole and the third restriction slot of the base/casing. The locking member is inserted into the first restriction slot of the outer tubular pole and second restriction slot 232-*k* of restriction structure 230-*k*. Under normal conditions (e.g., without pressing the lever or pulling away the inner/outer tubular poles), the elastic member will continue to exert an elastic force to the second portion of the lever, thereby pushing the first portion of the lever toward the third restriction slot of the base/casing and thus maintaining the locking member in the first position.

At this first position, proximal end 342 of first edge 341 of locking member 340 is disposed inside of the inner tubular pole whereas distal end 343 of first edge 341 of locking member 340 is disposed outside the inner tubular pole. As such, the locking member (e.g., proximal edge 344 of the locking member) would abut against the distal edge of the second restriction slot of the inner tubular pole to restrict the inner tubular pole from moving toward the outer tubular pole along the length direction of the inner tubular pole. Accordingly, when the locking member is at the first position, the locking/unlocking mechanism is referred herein as being in a first state (e.g., a locking state). In the locking state, the locking/unlocking mechanism prevents the telescopic pole from contracting (e.g., shortening its length. This prevents the tent frame from accidentally collapsing and ensures the safety of the tent frame.

In the meantime, because the first edge of the locking member is sloped and the distal end of the first edge is disposed outside the inner tubular pole, the locking member (e.g., distal edge 346 of the locking member) would not abut against the proximal edge of the second restriction slot of the inner tubular pole and thus would allow the inner tubular pole to move away from the outer tubular pole along the length direction of the inner tubular pole. This allows the telescopic pole to expand (e.g., increase its length) even when the locking/unlocking mechanism is in the locking state. As such, there is no need to unlock the locking/ unlocking mechanism when setting up the tent frame and when it is desired to increase the height of the tent frame. This makes the use of the tent frame very simple and convenient.

In some exemplary embodiments, the second restriction slot (e.g., second restriction slot 232-*k*) and the locking member are configured such that the dimension of the second restriction slot along the length direction of the inner tubular pole (e.g., the z-direction of FIG. 7) is smaller than that of the locking member. The smaller dimension of the second restriction slot prevents distal end 343 of the first edge of the locking member from being inserted into the inner tubular pole. As such, it ensures that the inner tubular pole can move away from the outer tubular pole along the length direction of the inner tubular pole to expand the telescopic pole even when the locking/unlocking mechanism is in the locking state.

In some exemplary embodiments, a restriction structure (e.g., restriction structure 230-*k*) includes a restriction tongue (e.g., restriction tongue 234-*k*). As the inner tubular pole moves away from the outer tubular pole along the length direction of the inner tubular pole, the restriction tongue abuts the first edge of the locking member toward the third restriction slot of the base/casing (e.g., to the right in FIG. 7), pushing the locking member out of the inner tubular pole. This helps to smooth the movement of the inner tubular pole relative to the outer tubular pole along the length direction of the inner tubular pole, thereby improving further the convenience of the telescopic pole and the tent frame. In some exemplary embodiments, the restriction tongue helps to prevent insertion of the locking member into the second restriction slot beyond the first position. In an exemplary embodiment, the restriction tongue is shaped in accordance with the first edge of the locking member.

At the second position, the locking member is removed from the second restriction slot of any one of the plurality of restriction structures of the inner tubular pole. For instance, as a non-limiting example, FIG. 8 illustrates that the locking member is removed from second restriction 233-*k* of restriction structure 230-*k*. Removing the locking member from the second restriction slot of the inner tubular pole can be achieved, for instance, by pressing the second portion of the lever toward the base, which in turn pulls the first portion of the lever away from the third restriction slot of the base/casing. Removing the locking member from the second restriction slot of the inner tubular pole disengages the inner tubular pole from the outer tubular pole. This allows the inner tubular pole to move in both directions (toward and away from the outer tubular pole) along the length direction of the inner tubular pole. Accordingly, when the locking member is at the second position, the locking/unlocking mechanism is referred herein as being in a second state (e.g., an unlocking state).

The telescopic poles and tent frames of the present disclosure have several advantages. For instance, due to at least in part the configurations of the locking member of the locking/unlocking mechanism and/or restriction structures of the inner tubular pole, the telescopic pole can expand (e.g., increase its length) with no need of unlocking the locking/unlocking mechanism. This makes the use of the telescopic pole and the tent frame very simple, convenient and user friendly. For instance, increasing the length of the telescopic pole and the height of the tent frame can be achieved by simply pulling away the inner and outer tubular poles regardless of whether the locking/unlocking mechanism is in the locking state or in the unlocking state. Moreover, due to at least in part the configurations of the restriction structures of the inner tubular pole, the telescopic pole can be adjusted to various different lengths (e.g., at least ten different lengths). This allows the tent frame to be adjusted to various different heights (e.g., at least ten different heights) to meet different needs or preferences of various users. Further, due to at least in part the configurations of the restriction structures of the inner tubular pole, adjusting the length of the telescopic pole can create sound effects (e.g., clicks at intervals) that make contracting/expanding the telescoping pole and setting up the tent frame fun and enjoyable.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first restriction structure could be termed a second restriction structure, and, similarly, a second restriction structure could be termed a first restriction structure, without changing the meaning of the description, so long as all occurrences of the "first restriction structure" are renamed consistently and all occurrences of the "second restriction structure" are renamed consistently.

What is claimed is:

1. A telescopic pole comprising:

an outer tubular pole comprising a first restriction slot formed on a first wall of the outer tubular pole;

an inner tubular pole comprising:

a proximal end disposed inside the outer tubular pole;

a distal end disposed outside the outer tubular pole; and a plurality of restriction structures formed at the inner tubular pole between the proximal end and distal end of the inner tubular pole and spaced apart along a length direction of the inner tubular pole, wherein each of the plurality of restriction structures comprises a second restriction slot formed on a first wall of the inner tubular pole that faces the first wall of the outer tubular pole; and a locking/unlocking mechanism configured to control movement of the inner tubular pole with respect to the outer tubular pole, the locking/unlocking mechanism comprising:

a base fixedly coupled with the outer tubular pole;

a casing integrally formed or coupled with the base;

a lever pivotally connected to the casing; and a locking member pivotally connected to the lever and comprising a first edge sloped along the length direction of the inner tubular pole;

wherein:

the base or the casing comprises a third restriction slot corresponding to the first restriction slot of the outer tubular pole and configured to guide the locking member to move along a width direction of the inner tubular pole between a first position and a second position when the lever pivots relative to the casing;

at the first position, the locking member is inserted into the first restriction slot of the outer tubular pole and the second restriction slot of any one respective restriction structure in the plurality of restriction structures of the inner tubular pole, with a proximal end of the first edge disposed inside of the inner tubular pole and a distal end of the first edge disposed outside the inner tubular pole, thereby restricting the inner tubular pole from moving toward the outer tubular pole along the length direction of the inner tubular pole but allowing the inner tubular pole to move away from the outer tubular pole along the length direction of the inner tubular pole; and at the second position, the locking member is removed from the second restriction slot of any one respective restriction structure in the plurality of restriction structures of the inner tubular pole, thereby allowing the inner tubular pole to move away from the outer tubular pole and to move toward the outer tubular pole.

2. The telescopic pole of claim 1, wherein the inner tubular pole or the outer tubular pole has a cross section in a substantially rectangular or square shape.

3. The telescopic pole of claim 1, wherein:

each of the plurality of restriction structures of the inner tubular pole comprise a restriction tongue at a proximal edge of the second restriction slot to prevent insertion of the locking member into the second restriction slot beyond the first position, and/or to aid the inner tubular pole to move away from the outer tubular pole along the length direction of the inner tubular pole when the locking member is at the first position.

4. The telescopic pole of claim 3, wherein the restriction tongue is shaped in accordance with the first edge of the locking member.

5. The telescopic pole of claim 3, wherein the restriction tongue abuts the first edge of the locking member to guide movement of the locking member when the locking member is in the first position and the inner tubular pole moves away from the outer tubular pole.

6. The telescopic pole of claim 1, wherein the lever comprises a first limiting member and a second limiting member spaced apart from each other in a depth direction of the inner tubular pole to accommodate the locking member.

7. The telescopic pole of claim 1, wherein the first edge of the locking member is substantially straight.

8. The telescopic pole of claim 7, wherein the first edge of the locking member is slanted relative to the length direction of the inner tubular pole at an angle within a range of from about 15° to about 45°.

9. The telescopic pole of claim 1, wherein the locking member comprises a proximal edge and a distal edge that are substantially straight and substantially perpendicular to the length direction of the inner tubular pole.

10. The telescopic pole of claim 1, wherein the locking member has a first dimension within a range of from about 15 mm to about 30 mm, and a second dimension within a range of from about 1 mm to about 3 mm.

11. The telescopic pole of claim 1, wherein:

the base comprises the third restriction slot and a support formed at a first side wall of the base;

the casing is integrally formed or coupled with the first side wall of the base and surrounds the third restriction slot and the support; and the lever comprises a first portion aligned with the third restriction slot, a second portion aligned with the support, and a third portion between the first and second portions and pivotally connected to the casing.

12. The telescopic pole of claim 11, wherein the locking/unlocking mechanism further comprises:

an elastic member engaged with the support, and having a first end abutting the base and a second end abutting the second portion of the lever, wherein when the second restriction slot of a restriction structure in the plurality of restriction structures of the inner tubular pole aligns with the first restriction slot of the outer tubular pole, the elastic member pushes the locking member into the second restriction slot of the restriction structure of the inner tubular pole.

13. The telescopic pole of claim 1, wherein the plurality of restriction structures comprises at least 10 restriction structures.

14. The telescopic pole of claim 1, wherein the plurality of restriction structures is distributed over at least half of the inner tubular pole along the length direction of the inner tubular pole.

15. The telescopic pole of claim 1, wherein adjacent restriction structures in the plurality of restriction structures are spaced apart along the length direction of the inner tubular pole at a distance within a range of from about 3 cm to about 5 cm, from about 4 cm to about 6 cm, or from about 5 cm to about 7 cm.

16. The telescopic pole of claim 1, wherein the inner tubular pole further comprises a plurality of indicators adjacent to the plurality of restriction structures to indicate positions of the plurality of restriction structures and/or relative positions of the inner tubular pole with respect to the outer tubular pole.

17. A telescopic pole comprising:

an outer tubular pole comprising a first restriction slot formed on a first wall of the outer tubular pole;

an inner tubular pole comprising:

a proximal end disposed inside the outer tubular pole;

a distal end disposed outside the outer tubular pole; and a plurality of restriction structures disposed between the proximal end and distal end of the inner tubular pole and spaced apart along a length direction of the inner tubular pole, wherein the plurality of restriction structures comprises at least 10 restriction structures and distributed over at least half of the inner tubular pole along the length direction of the inner tubular pole, and each of the plurality of restriction structures comprises a second restriction slot; and a locking/unlocking mechanism configured to control movement of the inner tubular pole with respect to the outer tubular pole, wherein the locking/unlocking mechanism is operable between a first state and a second state, wherein at the first state, the locking/unlocking mechanism allows the inner tubular pole to move away from the outer tubular pole along the length direction of the inner tubular pole but restricting the inner tubular pole from moving toward the outer tubular pole along the length direction of the inner tubular pole, and at the second state, the locking/unlocking mechanism allows the inner tubular pole to move away from the outer tubular pole and to move toward the outer tubular pole.

18. The telescopic pole of claim 17, wherein adjacent restrictions in the plurality of restriction structures are spaced apart along the length direction of the inner tubular pole at a distance within a range of from about 3 cm to about 5 cm, from about 4 cm to about 6 cm, or from about 5 cm to about 7 cm.

19. A tent frame comprising:

an upper frame; and a plurality of telescopic poles of claim 1, wherein each telescopic pole in the plurality of telescopic poles has a first end connected to the upper frame and a second end abutting a surface when the tent frame is in use.

20. A tent frame comprising:

an upper frame; and a plurality of telescopic poles of claim 17, wherein each telescopic pole in the plurality of telescopic poles has a first end for connecting to the upper frame and a second end for abutting a surface.

* * * * *